US006068133A

United States Patent [19]

Schönfeld et al.

[11] Patent Number: 6,068,133

[45] Date of Patent: May 30, 2000

[54] SYSTEM FOR SEPARATING NON-MAGNETIZABLE METALS FROM A MIXTURE OF SOLIDS

[75] Inventors: Joachim Schönfeld, Düsseldorf; Erwin Kaldenbach, Ratingen; Eberhard Stodt, Düsseldorf; Elmar Klomfass, Erkrath; Reyk Buch, Bonn; Jürgen Dillmann, Stuttgard; Willi Schneider, Haan, all of Germany

[73] Assignee: Steinert Elecktromagnetbau GmbH, Cologne, Germany

[21] Appl. No.: 08/983,063

[22] PCT Filed: Jun. 13, 1996

[86] PCT No.: PCT/DE96/01038

§ 371 Date: May 28, 1998

§ 102(e) Date: May 28, 1998

[87] PCT Pub. No.: WO97/00138

PCT Pub. Date: Jan. 3, 1997

[30] Foreign Application Priority Data

Jun. 14, 1995 [DE] Germany ..... 195 21 415

[51] Int. Cl.[7] ..... B03C 1/00

[52] U.S. Cl. ..... 209/219; 209/212; 209/225; 209/228

[58] Field of Search ..... 209/212, 217, 209/219, 225, 228, 636

[56] References Cited

U.S. PATENT DOCUMENTS

| | | | |
|---|---|---|---|
| 4,834,870 | 5/1989 | Osterberg et al. | 209/38 |
| 5,057,210 | 10/1991 | Julius | 209/212 |
| 5,394,991 | 3/1995 | Kumagai et al. | 209/212 |
| 5,626,233 | 5/1997 | Wells, II | 209/219 |

FOREIGN PATENT DOCUMENTS

| | | | |
|---|---|---|---|
| 0 305 881 | 3/1989 | European Pat. Off. | B03C 1/24 |
| 0 342 330 | 11/1989 | European Pat. Off. | B03C 1/02 |
| 0 550 867 | 7/1993 | European Pat. Off. | B03C 1/24 |
| 0 550 867 A1 | 7/1993 | European Pat. Off. . | |
| 527696 | 10/1921 | France . | |
| 6-254431 | 9/1994 | Japan | 209/219 |

OTHER PUBLICATIONS

Derwent Abstract corresponding to EP 0 342 330.
Derwent Abstract corresponding to EP 0 550 867.
International Search Report corresponding to PCT/DE 96 01038.
Derwent Abstract corresponding to 0 550 867.

*Primary Examiner*—Tuan N. Nguyen
*Attorney, Agent, or Firm*—Darby & Darby

[57] ABSTRACT

A system for separating non-magnetizable metals from a mixture of solid with a feed device; an endless conveyor belt with belt drums supported on a frame, of which the head drum at the discharge end is provided with a driven, eccentrically mounted and adjustable magnet rotor; and a separation area downstream of the head drum. To improve the degree of separation achieved, the system is provided with a vibrating channel (2) with an additional slope; means for adjusting the speed of the conveyor belt (3); means for generating a variable force of repulsion (Fvar); a controlled rotational speed adjustment unit (nvar) for the magnet rotor (3.4); and adjustable separating elements (4.1, 4.2, 4.3), each of which is located between two adjacent throwing parabolas of the separated fractions.

16 Claims, 2 Drawing Sheets

SYSTEM FOR SEPARATING NON-MAGNETIZABLE METALS FROM A MIXTURE OF SOLIDS

BACKGROUND OF THE INVENTION

The invention relates to a system for separating non-magnetizable metals, in particular nonferrous metals, from a mixture of solids. The main element of the system is an alternating magnetic field generator for deflecting the components of the mixture on parabolic trajectories, followed by at least two spaced apart separating elements.

STATE OF THE ART

A system of this type with the same main elements is known from DE 38 17 003 C1 and DE 00 093 A1 and has proven successful in day to day operations. In order to effectively separate mixtures of solids, the features of DE 38 17 003 C1, where the position of the rotational axis of the magnet rotor in the quadrant of the material release zone is changed for adjusting the effective range of the alternating field generated by the magnet rotor, are advantageously combined with the effect described in DE 00 093 A1, where several different components of a mixture of solids which are conveyed to the alternating field generator, are separated simultaneously in a single pass.

It would be advantageous to provide an improved sorting process of the separable fractions, in particular when the supplied mixtures of solids are quite heterogeneous and have different electromagnetic properties as well as different geometric shapes.

SUMMARY OF THE INVENTION

It is therefore an object of the invention to improve the quality of the separation process in a conventional system by combining several technical means, so that the system operates synergetically during the entire separation process—from the point where the mixture of solids is supplied, via the subsequent conveyor to the release region and separation zones defined by the ejection trajectories—and the various material fractions have a higher purity after separation.

This object is solved by the invention in that:

a) the feed device which has the form of a vibrating channel and is located in the transfer region, has a dispersing and acceleration section with an additional slope, so that the conveyed material is uniformly distributed and essentially resting on the conveyor belt, thereby protecting the conveyor belt, b) the conveyor includes means for controlling the velocity of the conveyor, so that the ratio mass flow/throughput efficiency can be adjusted, the residence time of the mixture of solids in the eddy current field of the magnet rotor can be controlled and the parabolic ejection trajectory of the respective constituent of the mixture of solids can be changed, c) the magnet rotor is designed so that the magnetic force can be adjusted to change the point where the respective constituent of the mixture of solids is released, over a range of $\geqq 90°$; an eddy current field generates a variable repulsive force which ejects the respective constituent of the mixture of solids away from the head drum in a manner specific for that material, d) the rotational speed of the magnet rotor can be controlled by a frequency converter and matched to the grain size and the material composition of the mixture of solids, wherein the rate of change of the magnetic field determines the magnetizing times, and e) the adjustable separating elements are placed halfway between two adjacent parabolic ejection trajectories of the separated fractions.

The system according to the invention advantageously combines the above features, such as the additional slope of the vibrating channel, the controllable velocity of the conveyor belt, the adjustablility and speed control of the magnet rotor, as well as the addition of a separating station, in the form of a synergistically operating system which is described in greater detail in the embodiments.

DETAILED DESCRIPTION OF THE INVENTION

The invention will now be discussed with reference to embodiments.

Figure 1:
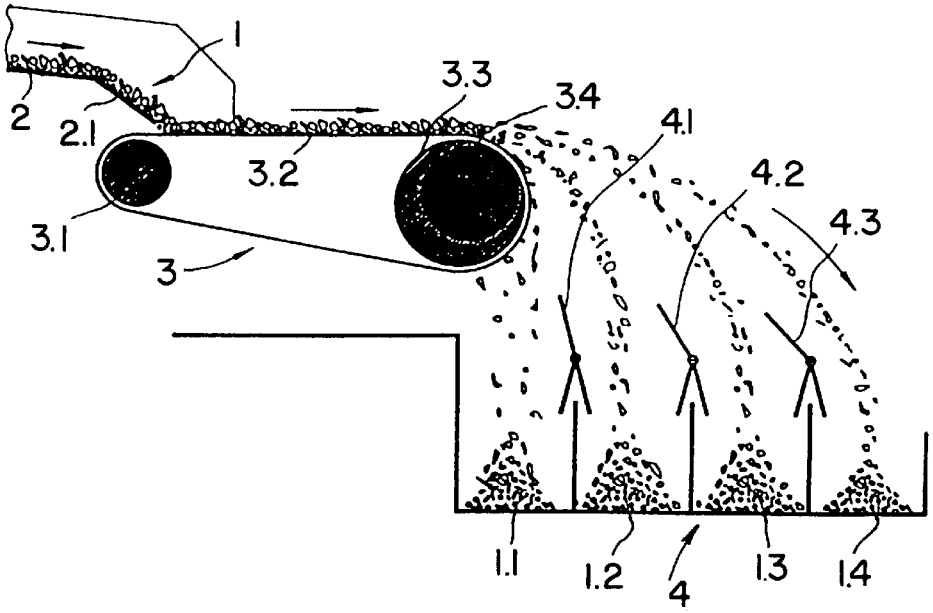
FIG. 1 schematically, a side view of the system of the invention showing the basic functions, FIG. 2 schematically, a side view of the head drum of the conveyor belt showing the basic operation of the eccentrically supported magnet rotor, FIG. 3 a front view of the head drum, and FIG. 4 a side view according to FIG. 3.

Referring first to FIG. 1, an essential element of the system is a generally inclined vibrating channel 2 for conveying—in the direction of the arrow—the mixture of solids 1 comprising, for example, iron/stainless steel (V2A), 1.1, nonmetals/stainless steel (V4A), 1.2, nonferrous metal mixture 1.3 and light metal mixture 1.4. According to the invention, the vibrating channel 2 has an additional slope 2.1. The system also includes a conveyor belt 3, the magnet rotor 3.4 and a separating station 4 for the individual fractions 1.1, 1.2, 1.3, 1.4. The magnet rotor 3.4 which separates the nonferrous metals, is eccentrically supported in a head drum 3.3.

Figure 2:
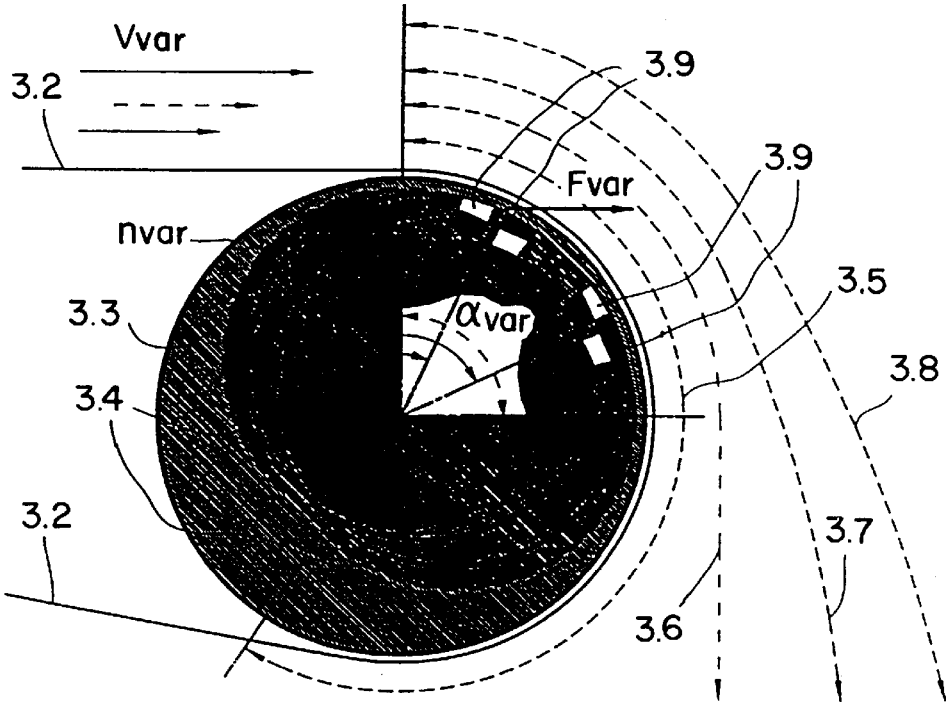
Figure 3:
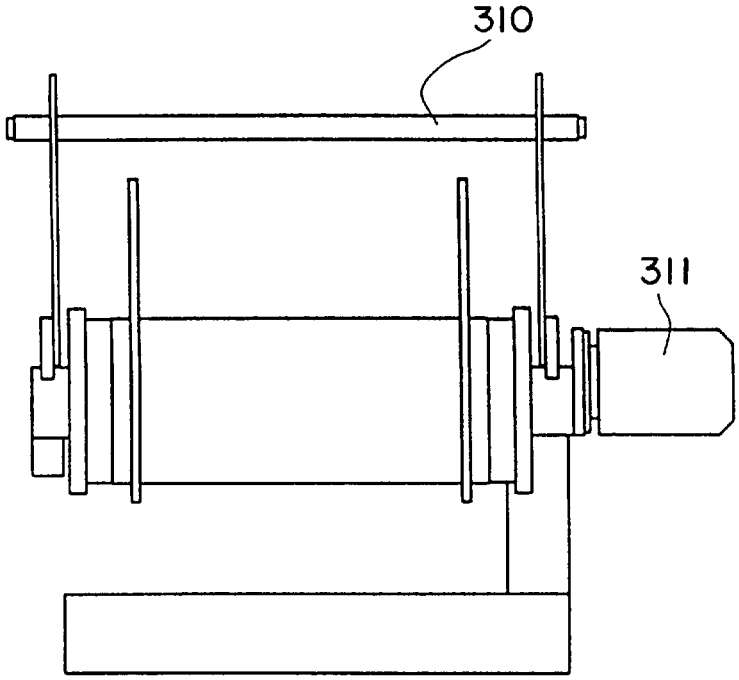
Figure 4:
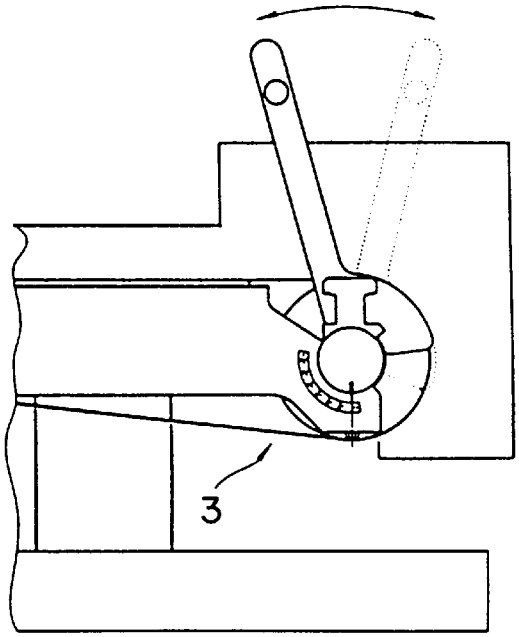

A continuous conveyor belt 3.2 revolves around the head drum 3.3 and a drive drum 3.1 which drives the conveyor belt 3.2. The driven magnet rotor 3.4 is, as mentioned above, eccentrically supported and adjustable at least over the range $\alpha$ var (FIG. 2) of the material release zone.

The separating station 4 is subdivided into various sections associated with each of the separable fractions. For example, iron/stainless steel (V2A), 1.1, originates from a material release zone 3.5 (FIG. 2), nonmetals/stainless steel (V4A), 1.2, originates from a material release zone 3.6, nonferrous metal mixture 1.3 from a material release zone 3.7 and light metal mixture 1.4 from a material release zone 3.8. In particular, the latter two mixtures are ejected from the material release zones 3.5 and 3.6 of the head drum 3.3 with different trajectories due to the effect of the magnet rotor 3.4 which is adjustable over the positional range a var.

The separating elements 4.1, 4.2, 4.3 advantageously protrude between adjacent parabolic trajectories of the separated fractions 1.1, 1.2 1.3 and 1.4; in every other aspect, the operation of the separating elements is identical to those described in DE 00 093 A1.

This system has the following unexpected overall advantages:

The region where the mixture of solids 1 is transferred to the conveyor belt 3.2, advantageously dislodges and accelerates the mixture due to the vibrating channel 2 which has the slope 2.1. The mixture of solids 1 is thus conveyed to the conveyor belt 3.2 in loose form and is accelerated. Quite unexpectedly, the mixture is distributed uniformly on the conveyor belt 3 and, most importantly, quickly settles. The design of the conveyor belt 3 advantageously also has a very short footprint, whereas in conventional systems, where the mixture of solids 1 is transferred by a vibrating channel 2 with a single slope, the mixture of solids 1 requires a considerable travel distance before settling on the conveyor belt 3.2. Consequently, this feature of the invention significantly improves the initial state and advantageously enhances the quality of the separation for the entire system.

As mentioned before, the mixture of solids 1 settles quickly and is then transferred close to the magnet rotor 3.4. A velocity control v var of the conveyor belt 3.2 permits an affective adjustment of the ratio mass flow/throughput efficiency of the mixture of solids 1. The velocity control v var changes the residence time in the eddy current field of the magnet rotor 3.4 and thereby the parabolic trajectory which is a function of the specific properties and composition of the components of the mixture of solids 1.

All attempts to realize this effect have failed in the past, although there was a long-felt need. Due to this effect, the mixture advantageously settles before the subsequent process steps are carried out which is a direct result of the specific design of the conveyor belt 3.

As mentioned above, this effect is particularly advantageous for the subsequent process steps in that the grain size and the material composition of the components of the separable mixture of solids 1 can be controlled by varying the time dependence of the magnetic field. The rotational speed n var of the magnet rotor 3.4 can be controlled by a frequency converter (not shown) and different magnetizing times can be selected. In this way, This advantageously enhances the efficiency of the separating station 4 for generating pure fractions 1.1 to 1.4.

The effects described above are enhanced further by the characterizing features of the additional claims 2 to 7, thus providing pure fractions 1.1 to 1.4. Additional advantageous embodiments which make the operation safer and enhance the quality of the separation, are described in claims 8 to 24; these subject matter of these claims contributes to the desired synergistic effect.

Industrial applicability

Experiments have demonstrated that the system of the invention can be advantageously used to further improve the purity of the fractions separated from the supplied mixtures of solids which can be rather heterogeneous. The quality of the separated end products is determined by their different electromagnetic and physical properties as well as their different geometrical shapes.

List of reference numerals

1 mixture of solids

1.1 fraction iron/stainless steel (V2A)

1.2 fraction nonmetals/stainless steel (V4A)

1.3 fraction nonferrous metal mixture

1.4 fraction light metal mixture

2 vibrating channel

2.1 additional slope

3 conveyor

3.1 drive drum

3.2 conveyor belt

3.3 head drum

3.4 magnet rotor

3.5 material release zone (for Fe)

3.6 material release zone (for nonmetals/V4A)

3.7 material release zone (for nonferrous metal mixture fraction)

3.8 material release zone (for nonferrous light metals)

3.9 magnets

3.10 parallelogram linkage

3.11 drive motor for magnet rotor 3.4

4 separating station

4.1 separating element

4.2 separating element

4.3 separating element v var velocity control of the conveyor 3

F var variable repulsive force

α var adjustable position of the magnet rotor 3.4 n var rotational speed adjustment of the magnet rotor 3.4 schematic representation of the alignment of a separating element (4.1, 4.2 or 4.3) by tilting about the axis schematic representation of the advance of a separating element (4.1, 4.2 or 4.3) by horizontal adjustment of the axis schematic representation of the advance or the placement of a separating element (4.1, 4.2 or 4.3) by vertical adjustment of the axis.

We claim:

1. A system for separating non-magnetizable metals from a mixture of solids, the system comprising a conveying device for conveying the mixture of solids, a conveyor (3) including a continuous conveyor belt (3.2) having belt drums supported on a frame for transporting the mixture of solids, wherein a head drum (3.3) located on the supply end comprises a driven, eccentrically supported, adjustable magnet rotor (3.4) which deflects the components of the mixture of solids through alternating magnetic field generators onto different parabolic trajectories specific for the material, as well as a separating station (4) with separating elements (4.1, 4.2, 4.3) following the head drum (3.3), wherein the magnet rotor (3.4) is provided with rotational speed control (n var) which is controlled by a frequency converter, for accommodating the respective grain size to be separated and the material composition of the mixture of solids, wherein the magnetizing times are changed by varying the magnetic field, and wherein each of the separating elements (4.1, 4.2, 4.3) is disposed between two adjacent parabolic ejection trajectories of the separated fractions (1.1, 1.2, 1.3, 1.4) and is adjustable, wherein a) preceding the conveying device, a feed device is provided, including a vibrating channel (2) including a dispersing section and an acceleration section having an additional slope (2.1) for uniformly distributing and settling the mixture of solids (1) on the conveyor belt (3.2) for protecting the conveyor belt, b) the conveyor (3) includes means for controlling the velocity (v var) of the conveyor, such as to adjust the ratio mass flow/throughput efficiency, the residence time of the mixture of solids (1) in the eddy current field of the magnet rotor (3.4) is controllable and the parabolic ejection trajectory of the respective constituent of the mixture of solids (1) is changeable, c) the magnet rotor (3.4) is constructed and adjustable such as to adapt the magnetic force to the release point of the respective constituent of the mixture of solids (1) over a range (α var) of ≧90° such as to generate a variable repulsive force (F var) by an eddy current field for repelling the respective constituent of the mixture of solids away from the head drum (3.3) in a manner specific for that material.

2. The system according to claim 1, wherein the head drum (3.3) and the conveyor belt (3.2) that wraps around the head drum, is constructed with walls thin enough for bringing the magnetic field closer to the components of the mixture of solids (1), so that the repulsive force (F var) is increased.

3. The system according to claim 2, wherein the conveyor belt (3.2) has a thickness in the range of 1.7 to 4 mm.

4. The system according to claim 2 wherein the head drum (3.3) has a wall thickness of approximately 4 mm at an operational width of 1000 mm and is preferably manufactured from glass-fiber reinforced plastic.

5. The system according to claim 1, wherein the magnet rotor (3.4) is provided with fine poles for increasing the pole change frequency and the repulsive force (F var).

6. The system according to claim 5, wherein the magnet rotor (3.4) comprises magnets (3.9) made from a neodymium-iron-boron alloy for generating a strong eddy current field.

7. The system according to claim 5, wherein the magnet rotor (3.4) comprises magnets (3.9) arranged in the form of multiple poles for increasing the range of the pole change frequency from about 320 (480) to about 1040 (1440) Hz and the repulsive force (F var) while maintaining the same maximum rotational speed of the magnet rotor (3.4) of about 2400 (3600) $min^{-1}$.

8. The system according to claim 1, wherein a parallelogram linkage is provided for adjusting the magnet rotor (3.4) and for uniformly loading the bearings of the magnet rotor (3.4).

9. The system according to claim 1, wherein a vibration monitor is provided in the area of the magnet rotor bearings (3.4) for finding an undesirable imbalance.

10. The system according to claim 1, wherein the belt operation is monitored on the head drum (3.3) by a pulse transmitter which detects the rotation of the head drum (3.3) driven by the conveyor belt and indicates a malfunction.

11. The system according to claim 1, wherein the rotational speed of the magnet rotor (3.4) is monitored independent of the frequency converter through an electronic two-channel safety guard system for preventing an excessive rotational speed which could cause magnets (3.9) to become detached.

12. The system according to claim 1, further comprising a drive motor (3.11) for the magnet rotor (3.4) including an automatically actuable mechanical brake which becomes effective in the event of at least one of a power loss, an emergency shut-off, a switch-off of the system and triggering the vibration monitor, the belt operation monitor and the rotational speed monitor.

13. The system according to claim 1, wherein the separating elements (4.1, 4.2, 4.3) are adjustable such that in order to prevent portions of the separated fractions (1.1, 1.2, 1.3, 1.4) from rebounding, the separation surfaces of the separating elements form median chords and median tangents between the parabolic trajectories of the fractions (1.1, 1.2, 1.3, 1.4).

14. The system according to claim 1, further comprising combined means for orienting at least one of the separating elements (4.1, 4.2 or 4.3) by tilting about the axis as well as for advancing the same into the respective designated separation section, wherein a horizontal adjustment of the axis is used for advancing at least one of the elements and a vertical adjustment of the axis is used for advancing and placing the elements.

15. The system according to claim 1, further comprising combined means for acting on a gear shifting gate.

16. The system according to claim 1, wherein on the conveyor belt (3.2) there are provided tangs for extracting magnetic fractions from the region of the magnet.

* * * * *